US010760383B2

(12) United States Patent
Mitchell et al.

(10) Patent No.: US 10,760,383 B2
(45) Date of Patent: Sep. 1, 2020

(54) FAIL-SAFE HIGH VELOCITY FLOW CASING SHOE

(71) Applicant: WWT NORTH AMERICA HOLDINGS, INC., Houston, TX (US)

(72) Inventors: Sarah Mitchell, Fullerton, CA (US); Andrew Trowbridge, Anaheim, CA (US)

(73) Assignee: WWT NORTH AMERICA HOLDINGS, INC., Houston, TX (US)

( * ) Notice: Subject to any disclaimer, the term of this patent is extended or adjusted under 35 U.S.C. 154(b) by 345 days.

(21) Appl. No.: 15/828,130

(22) Filed: Nov. 30, 2017

(65) Prior Publication Data

US 2018/0179864 A1 Jun. 28, 2018

Related U.S. Application Data

(60) Provisional application No. 62/439,766, filed on Dec. 28, 2016.

(51) Int. Cl.

| | |
|---|---|
| ***E21B 41/00*** | (2006.01) |
| ***E21B 17/14*** | (2006.01) |
| ***E21B 43/10*** | (2006.01) |
| ***E21B 33/14*** | (2006.01) |

(52) U.S. Cl.
CPC ..... *E21B 43/106* (2013.01); *E21B 17/14* (2013.01); *E21B 33/14* (2013.01); *E21B 41/0078* (2013.01)

(58) Field of Classification Search
None
See application file for complete search history.

(56) References Cited

U.S. PATENT DOCUMENTS

| | | | | |
|---|---|---|---|---|
| 2,150,311 | A * | 3/1939 | Baker | E21B 33/14 166/222 |
| 2,286,126 | A * | 6/1942 | Thornhill | E21B 21/10 166/193 |
| 2,812,821 | A * | 11/1957 | Nelson | E21B 21/10 166/325 |
| 2,872,983 | A * | 2/1959 | Renouf | E21B 33/14 166/141 |
| 3,159,219 | A | 12/1964 | Scott | |
| 4,076,311 | A | 2/1978 | Johns | |
| 4,474,243 | A * | 10/1984 | Gaines | E21B 7/185 166/242.8 |
| 5,960,881 | A * | 10/1999 | Allamon | E21B 21/103 166/285 |
| 7,216,727 | B2 * | 5/2007 | Wardley | E21B 7/20 175/402 |
| 7,334,650 | B2 * | 2/2008 | Giroux | E21B 7/06 175/26 |
| 7,484,559 | B2 | 2/2009 | Vert et al. | |
| 7,909,109 | B2 | 3/2011 | Angman et al. | |

(Continued)

FOREIGN PATENT DOCUMENTS

| | | |
|---|---|---|
| GB | 1012282 | 12/1965 |

*Primary Examiner* — Shane Bomar
(74) *Attorney, Agent, or Firm* — Lewis Roca Rothgerber Christie LLP

(57) ABSTRACT

A casing shoe having a composite body portion, a coupling portion attached to one end of the body portion, and a one-way check valve assembly positioned in the body portion, the valve assembly and body portion having a centerline nozzle and a plurality of circumferentially spaced smaller diameter nozzles positioned around the centerline nozzle.

19 Claims, 7 Drawing Sheets

(56) References Cited

U.S. PATENT DOCUMENTS

| | | | | |
|---|---|---|---|---|
| 7,938,201 | B2 * | 5/2011 | Giroux | E21B 21/001 166/208 |
| 9,702,197 | B2 | 7/2017 | Mitchell | |
| 9,708,891 | B2 | 7/2017 | Mitchell et al. | |
| 2004/0154810 | A1 * | 8/2004 | Nobileau | E21B 17/08 166/384 |
| 2006/0278393 | A1 | 12/2006 | Hunt et al. | |
| 2008/0271883 | A1 * | 11/2008 | Barton | E21B 34/063 166/332.8 |
| 2009/0261285 | A1 * | 10/2009 | Quinn | F16K 1/2028 251/298 |
| 2011/0180261 | A1 * | 7/2011 | Beattie | E21B 17/14 166/285 |
| 2014/0110098 | A1 * | 4/2014 | Mitchell | E21B 43/10 166/54 |
| 2018/0266206 | A1 * | 9/2018 | Berscheidt | E21B 33/128 |

* cited by examiner

FAIL-SAFE HIGH VELOCITY FLOW CASING SHOE

CROSS-REFERENCE TO RELATED APPLICATION(S)

This application claims priority to and the benefit of U.S. Provisional Application No. 62/439,766 filed Dec. 28, 2016, the contents of which are incorporated herein.

BACKGROUND OF THE INVENTION

When drilling oil and gas wells, it is important to have pressure containment, formation isolation, and well integrity to have a well that is safe and productive. Therefore, it is critical to have casing run to the desired depth and cemented in place in the wellbore to provide an adequate pressure boundary for well integrity. Also, to minimize well construction costs, it is also important to minimize the time needed to run casing to the desired setting depth. Time spent attempting to work past an obstruction, is money wasted. Downhole obstructions can consist of settled cuttings, formation caving due to wellbore instability, mud weight material sag, salt flows, or tar flows. These problems can occur in offshore and onshore wells.

A majority of land based wells drilled in the world are horizontal wells. These types of wells are often drilled quickly, and as a result of the high inclination horizontal production zone pose a particular problem in fully cleaning cuttings from the wellbore. As a result, operators sometimes encounter difficulties in running intermediate and production casing to the bottom of the wellbore. The ability to generate high velocity flow from the bottom of the casing string would greatly help run casing past areas of settled cuttings.

Many deepwater wells in the Gulf of Mexico as well as some extended reach wells drilled from land based rigs experience zones with tar that can seep into the newly drilled wellbore, making it difficult to run casing through these areas.

There have been numerous attempts to deal with adverse downhole conditions through a variety of casing shoe designs. The 'shoe' is the bottom most section of a wellbore casing. Some of the existing methods include reamers or cutting structure located on the shoe, methods of allowing or forcing the shoe to rotate, and blunt guides to allow the casing to traverse obstructions.

There are 'jetting' shoes available, but these 'jetting' shoes need very large flow areas to be able to allow displaced fluid to enter the casing, and to circulate cement and large particulate lost circulation material (LCM) to be pumped through the shoe. Often, the large bore center nozzle remains, and additional 'nozzles' are drilled facing downhole or up hole to provide some additional directed flow. As a result, the total flow area is far too large to provide a true high velocity flow stream that would have any effect on downhole obstructions as mentioned above. Some reamer shoes do have some smaller nozzles, but they also have limited ability to circulate cement or LCM if these nozzles become plugged rendering them vulnerable and ineffective in many circumstances.

Also there currently exists no means to work casing through areas of tar. Often casing will not be able to work through tar flows because of the above requirements for a large flow area required to allow fluid to flow in from the bottom of the casing as a result of the fluid displaced by the casing while running into the hole. If there is a large 'surge' effect caused by pressure buildup at the bottom of the wellbore, this could result in fracturing the formation and causing loss of well control. Therefore, 'auto-fill' casing float equipment creates a large flow area to allow the fluid to enter the casing unobstructed. Consequently a need exists for a casing shoe that addresses the drawbacks of existing designs and resolves the problems previously unaddressed with running casing.

SUMMARY OF THE INVENTION

The present invention is a way to provide low flow area, high velocity flow out of the bottom of the casing shoe to clean the hole and wash through many downhole obstructions, including settled cuttings, caved in formation, and flows of tar or salt. The present invention also provides a means to allow unobstructed flow of fluid into the casing to minimize wellbore pressure 'surge' while running casing. The present invention also provides a means to convert the casing shoe to a large flow area out of the shoe if needed for pumping cement or LCM out of the shoe, or if the smaller high velocity nozzles become plugged.

The present invention is a casing shoe that has a one-way check valve or flapper valve that allows unobstructed flow into the casing through a large flow area centerline nozzle, but forces flow out through multiple, circumferentially spaced, small diameter nozzles. Flow out through the smaller nozzles causes a pressure differential between the inside and outside of the casing shoe that increases as flow rate increases. This pressure differential also serves to place a load that serves to close the check/flapper valve. The valve assembly includes tabs that support the flapper door section of the valve. At a pre-determined pressure differential, the tabs shear to allow the flapper door to open, greatly increasing the flow area, resulting in unrestricted flow of cement, LCM, or drilling fluid.

An aluminum or steel machined coupling is machined with threads on one end to allow connection to the bottom of the casing or other casing accessories such as float collars. The other end of the coupling contains a series of axial and circumferential grooves that retain the cast portion of the guide shoe to allow the shoe to rotate and resist axial loading.

The one-way check valve is an assembly consisting of a flapper door, a base, a seal, and a hinge. The hinge can be a separate part, or is integrated into the other parts. The flapper door and base are made of a relatively hard and strong thermoplastic, thermoset polymer, metal, or ceramic that is easily drilled up with rock drilling bits. The door is hinged, and allowed to open freely in the up hole direction, providing a large flow area. The door closes in the downhole direction, and is prevented from opening in the downhole direction by a series of tabs. These tabs are designed to shear at a predetermined load to provide an alternate flow path through the shoe if the differential pressure within the casing reaches a predetermined pressure or flow rate. An embodiment of this assembly uses a 3D printed, polyetherimide (PEI) flapper and base made using the fused deposition modeling (FDM) method, though the parts could be made using injection molding, machining, or casting using PEI or other materials as mentioned above.

An embodiment uses the seal as a hinge, and is cast into place using an elastomeric material such as polyurethane. With an embodiment, no metallic materials are located within the drill out path that might damage the drill bit. Aluminum and steel in the drill out path can slow down the drill out process after the casing has been set and the operator continues drilling out of the casing and into the next hole section.

The valve assembly is cast into a body portion of the casing shoe to embed the valve assembly within a guide made of hard polyurethane, cement, or fiber reinforced cement or thermoset polymer composite material. The valve assembly is cast in such a way as to create multiple circumferentially spaced small diameter nozzle flow paths.

DETAILED DESCRIPTION

Figure 1:
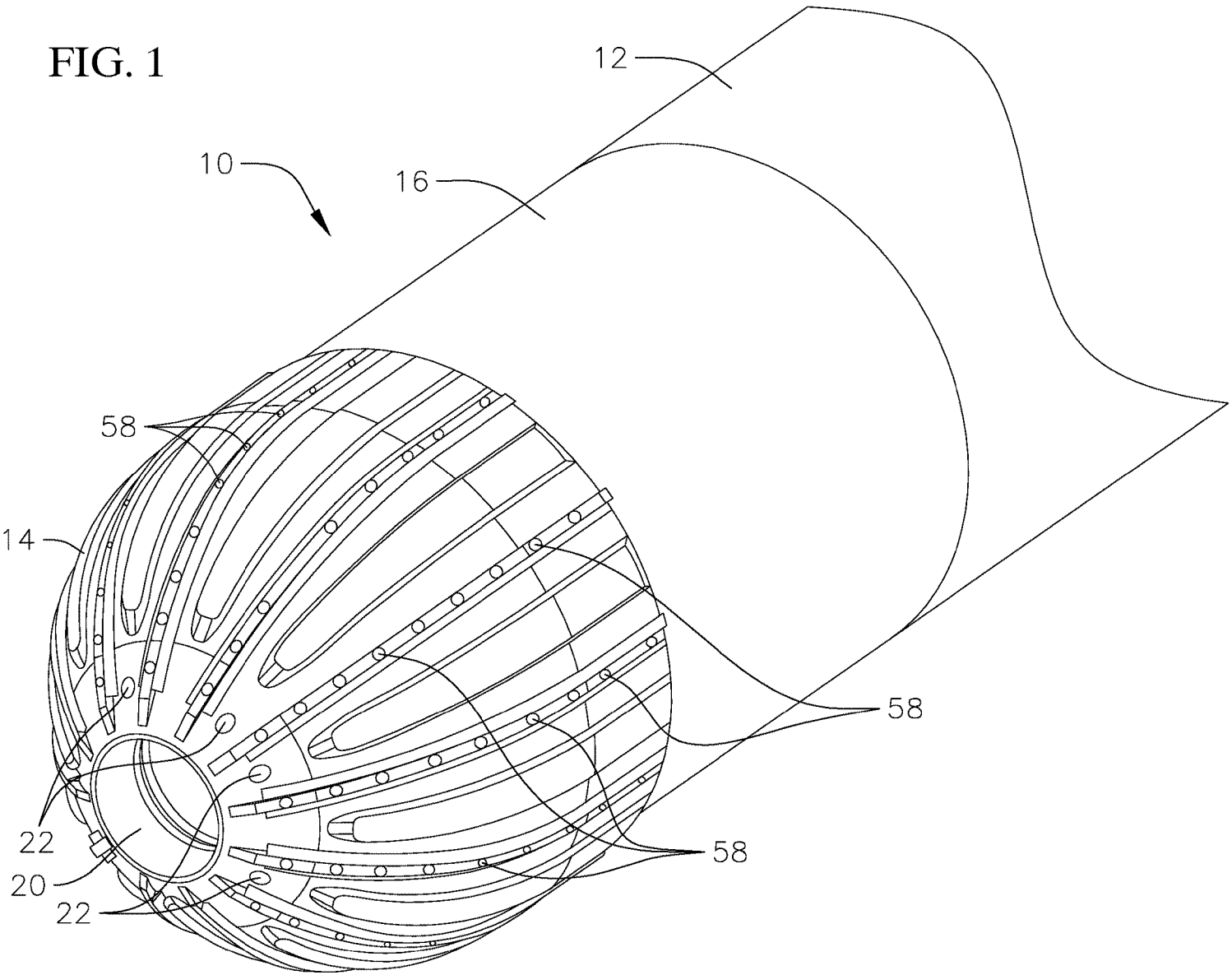
FIG. 1 is a perspective view of the casing shoe of the present invention.
Figure 2:
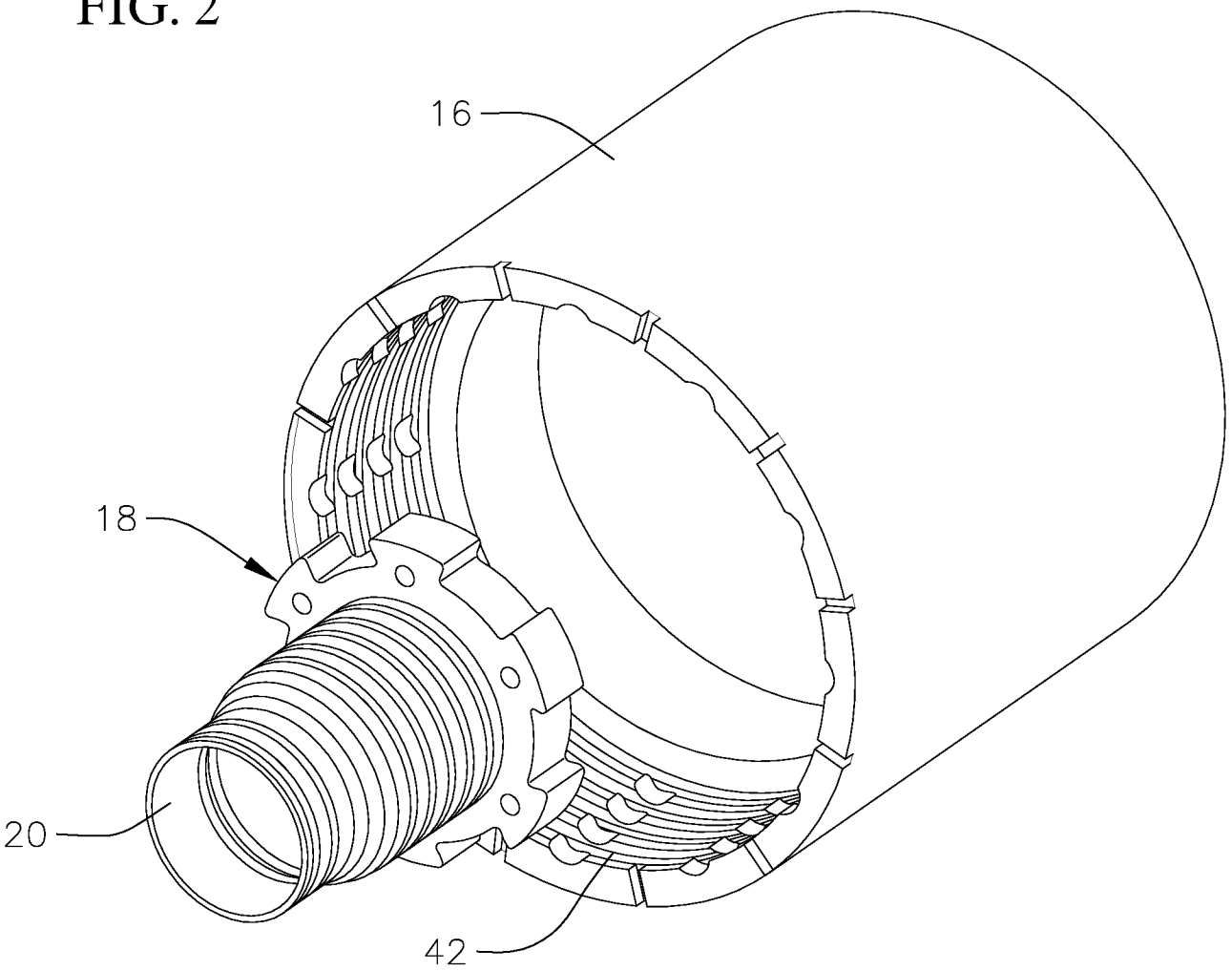
FIG. 2 is a perspective detail view of the casing shoe of FIG. 1 having the cast body section removed and illustrating the check valve assembly.

Referring to FIGS. 1-4, the present invention is a casing shoe 10 for attachment to the bottom of a wellbore casing 12 to provide low flow area, high-velocity flow out of the bottom of the casing shoe to clean the wellbore and wash through downhole obstructions. The casing shoe also provides a means to allow unobstructed flow of fluid into the casing to minimize wellbore pressure surge while running casing and provides a means to convert the casing shoe to a large flow area out of the shoe in needed for pumping cement or loss circulation material (LCM) out of the shoe, or if the smaller high-velocity nozzles become plugged. The casing shoe 10 includes a cast body portion 14 and a coupling portion 16. Positioned within the body portion is a one-way check valve or flapper valve assembly 18 that allows unobstructed flow into the casing through a large flow area centerline nozzle 20, but forces flow out through multiple, circumferentially spaced, small diameter nozzles 22. Flow out through the nozzles 22 causes a pressure differential between the inside and outside of the casing shoe that increases as flow rate increases. The pressure differential also serves to place a load that serves to close the valve assembly 18.

Figure 3A:
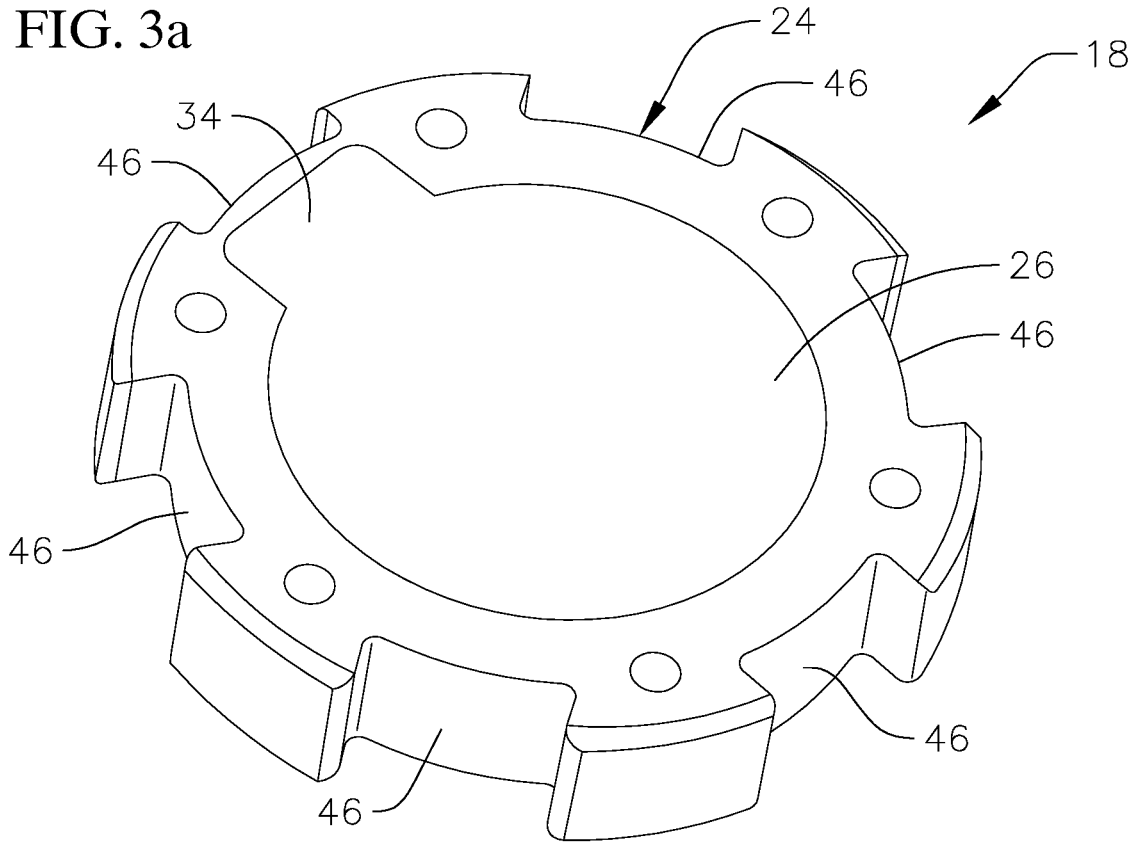
FIG. 3*a* is a perspective detail view of the check valve assembly illustrating the valve base and the seal.
Figure 3B:
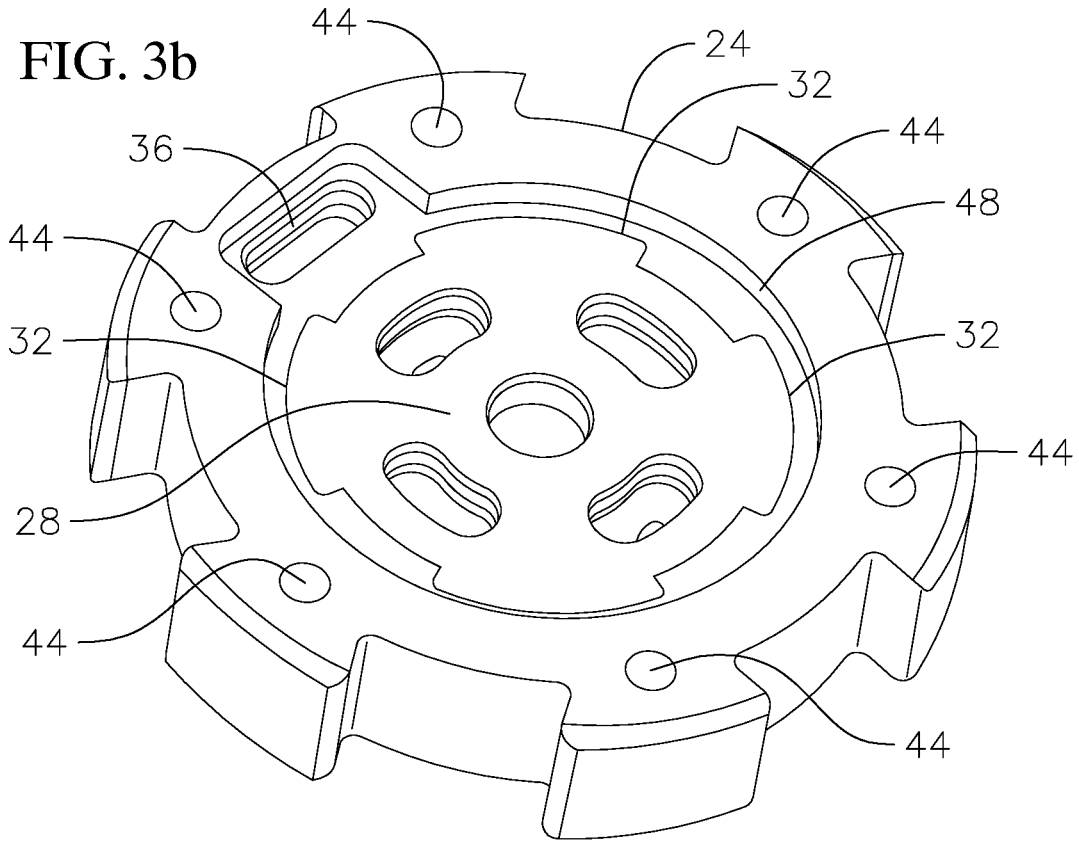
FIG. 3*b* is a perspective view of the valve assembly of FIG. 3*a* with the seal removed and illustrating the flapper door attached to the base.
Figure 3C:
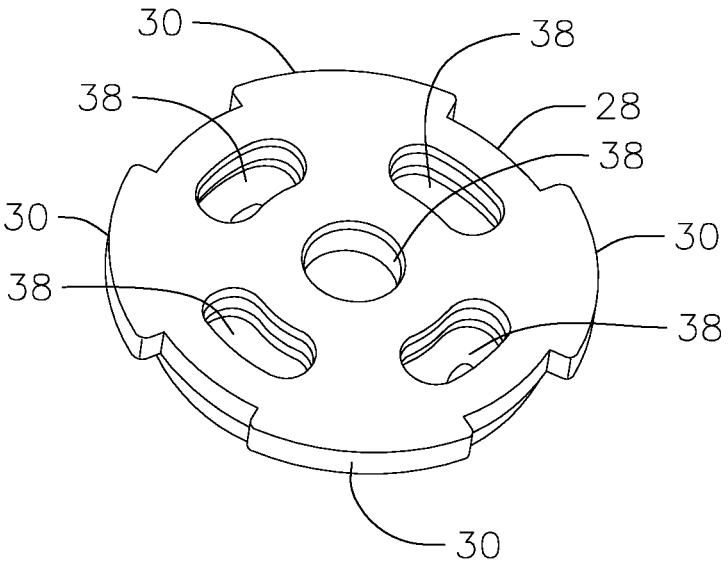
FIG. 3*c* is a detail perspective view of the flapper door of FIG. 3*b;*

As shown in FIGS. 3*a*-3*c* the valve assembly 18 includes a flapper base 24, a flapper seal 26, and a flapper door 28. The door 28 includes tabs 30 spaced around the perimeter of the door for receipt within recesses 32 in the flapper base 24 to support the door within the valve assembly. At a predetermined pressure differential, the tabs shear to allow the flapper door to open, greatly increasing the flow area, resulting in unrestricted flow of cement, LCM or drilling fluid through the casing shoe.

The seal 26 includes a hinge portion 34 for attachment to the base 24 by the hinge portion being inserted into a recess 36 in the base. The door 28 also has five recesses 38 extending therethrough to hold portions of the flapper seal 26 extending into the recesses. Recesses 38 are dove-tail shaped to lock the flapper seal in place. Consequently, the valve assembly consists of the flapper door, base, seal, and hinge. The hinge can be a separate component or is integrated into the other components of the assembly. The flapper door and base are made of a relatively hard and strong thermoplastic, thermoset polymer, metal or ceramic that is easily drilled up with rock drilling bits. The door is hinged, and allowed to open freely in the uphole direction providing a large flow area. The door closes in the downhole direction and is prevented from opening in the downhole direction by the series of tabs. The tabs are designed to shear at a predetermined load to provide an alternate flow path through the shoe if the differential pressure within the casing reaches a predetermined pressure or flow rate.

Figure 4A:
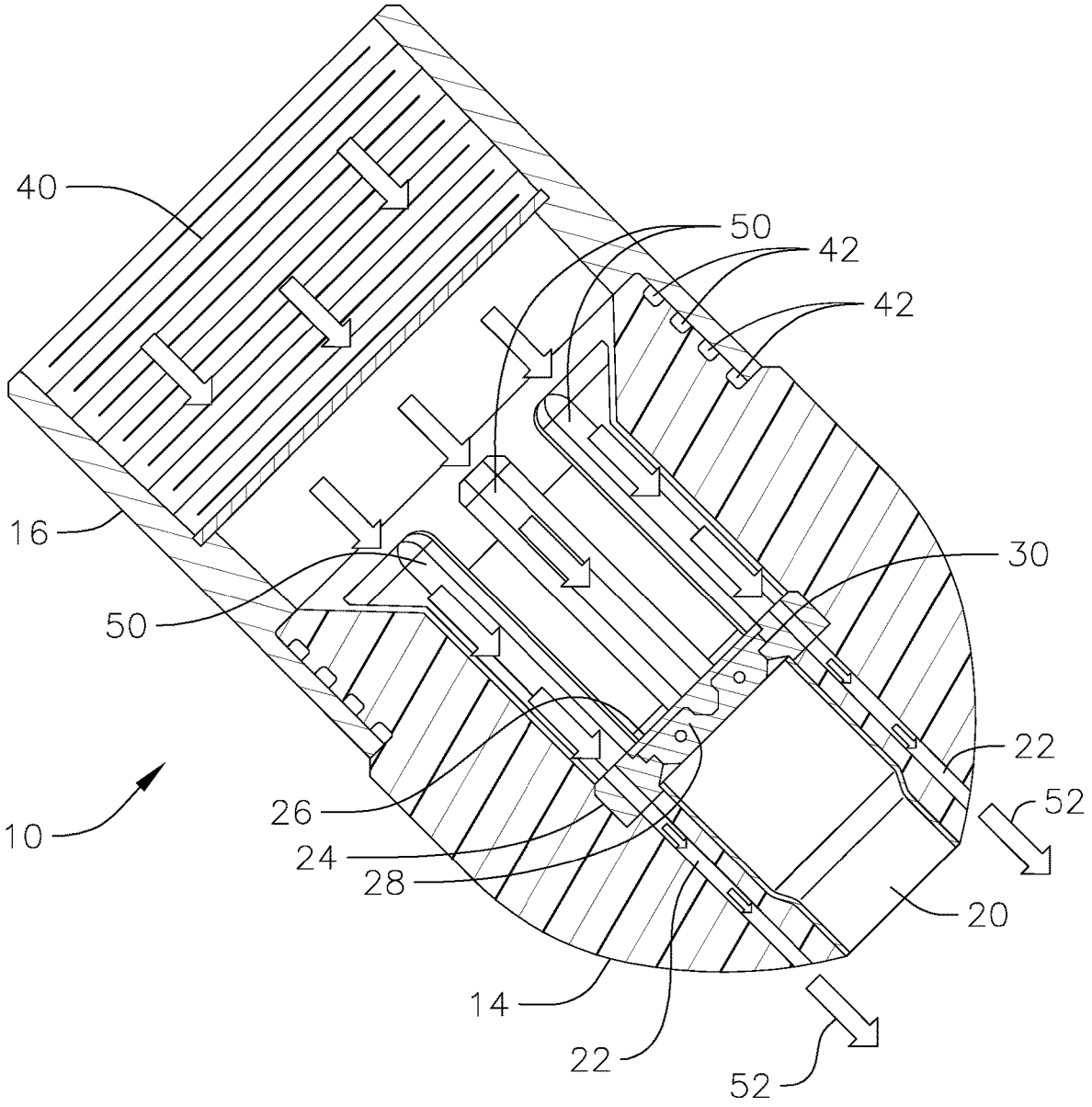
FIG. 4*a* is a cross-sectional view of the casing shoe illustrating flow through the casing shoe when the flapper door is closed.

The coupling portion 16 can be made of aluminum or steel and includes threads 40, as shown in FIG. 4*a* to allow connection to the bottom of casing 12 or other downhole casing accessories such as float collars. The other end of the coupling contains a series of axial and circumferential grooves 42 that retain the body portion 14 of the casing shoe to allow the shoe to rotate and resist axial loading.

The base 24 includes holes 44 extending through and circumferentially spaced around the base and aligned with nozzles 22 to create a high-velocity flow path. The base also has a plurality of grooves 46 positioned around the outside diameter of the base which locks the valve assembly in place within the cast body portion 14. The base also has a recessed portion 48 for receipt of the seal 26.

Figure 4B:
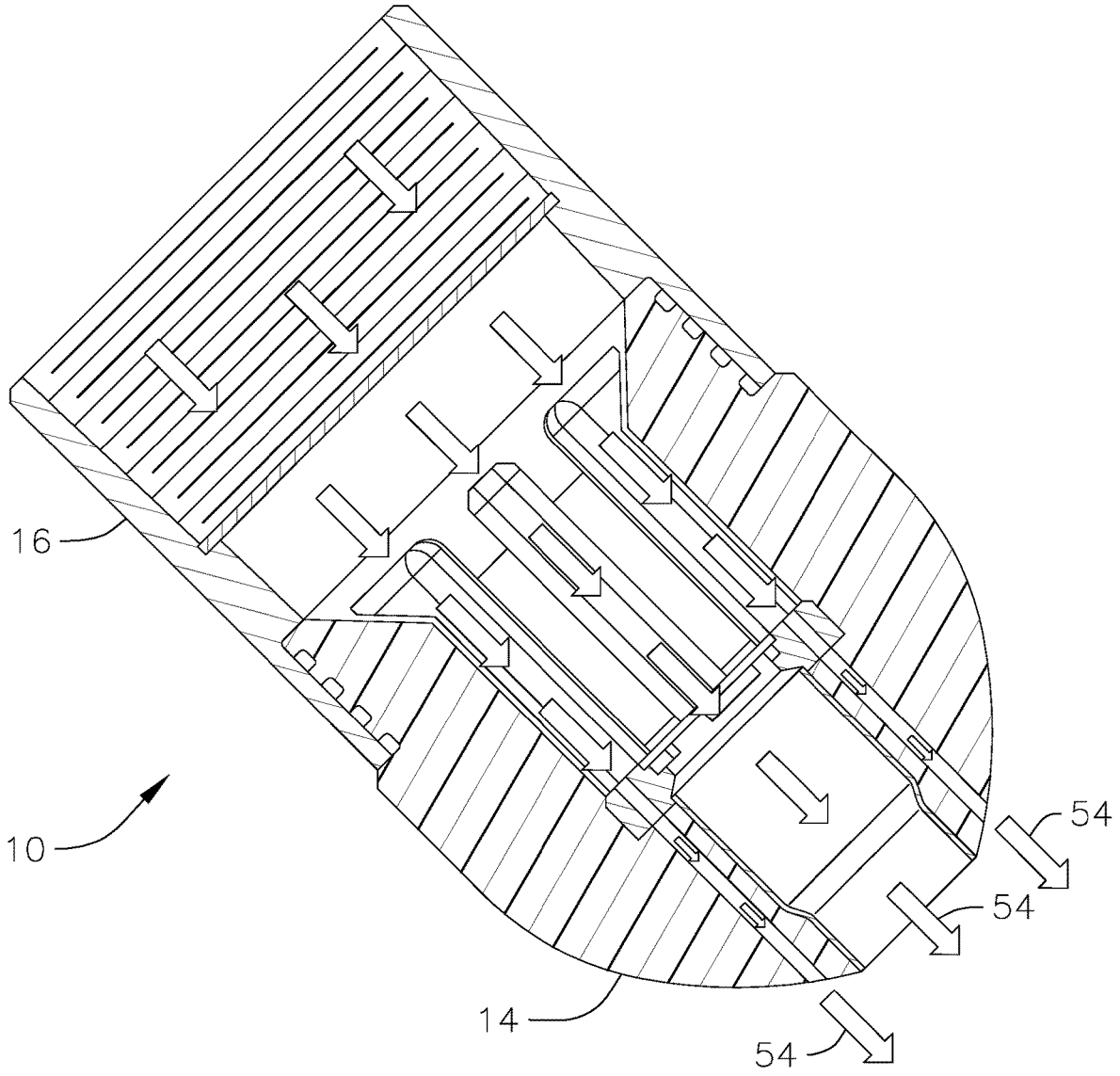
FIG. 4*b* is a cross-sectional view of the casing shoe illustrating flow through the casing shoe after the flapper door shears and opens.

As indicated, the valve assembly is cast into the body portion of the casing shoe to embed the valve assembly within a guide made of hard polyurethane, cement or fiber reinforced cement or thermoset polymer composite material. The valve assembly is cast to create multiple circumferentially spaced small diameter nozzle flow paths as shown best in FIGS. 4*a* and 4*b*. Positioned within the inside diameter of the body portion are ribs 50 to prevent rotation of cement when drilling out through the casing show. Ribs 50 are positioned uphole of the valve assembly opposite from the centerline nozzle 20. FIG. 4*a* depicts flow through the high-velocity small diameter nozzles 22 when the flapper door of the valve assembly is closed as illustrated by arrows 52. FIG. 4*b* depicts flow through the high velocity small diameter nozzles 22 and the large centerline nozzle 20 after the flapper door shears and the valve assembly is open as illustrated by arrows 54.

Example of Range of Operating/Design Parameters:

Casing size: from 4½" to 18" casing (nominal outside diameter of casing).

Flow rates: from 100 to 800 gal./min, depending on well conditions, with larger casing normally requiring larger flow rates.

Pressure drop across small diameter high flow velocity nozzles: 150 to 400 psi at user requested normal flow rate. Nozzles are sized to generate a pressure drop of 60 to 50% to 80% of flapper shearing pressure at user specified normal flow rate.

Number of small diameter high flow velocity nozzles: 4 to 12, with an embodiment having 6 to 9 circumferentially spaced nozzles aligned axially with the casing. Nozzles may be angled outward at up to 45 degrees to aid in circulation.

Differential pressure required to shear flapper and open centerline nozzle: 300 to 800 psi, with an embodiment shearing at 400 to 500 psi in 4½ inch to 7⅝ inch sizes, and 300 to 400 psi in sizes larger than 7⅝ inch nominal casing diameter.

Flow area in main centerline nozzle: 1.5 inches to 12 square inches, depending on the casing size. Larger casing requires larger flow area due to greater displaced fill volume requiring larger flow rates into the casing when running into the hole. Pressure drop across all nozzles should be less than 20 psi when running into the hole at desired casing running speed.

Differential pressure required to shear flapper and open centerline nozzle: 300 to 800 psi, with an embodiment shearing at 400 to 500 psi in 4½ inch to 7⅝ inch sizes, and 300 to 400 psi in sizes larger than 7⅝ inch nominal casing diameter.

The number of small diameter nozzles is from 4 to 12, with a typical number from 6 to 9 which allows for large enough nozzle diameters to allow sand and other particulate to pass without clogging, but generates a high enough velocity to create a 200 to 600 psi pressure drop across the nozzles at normal circulation rates and a large diameter centerline nozzle (defined as a function of flow rates) flow path that is open or closed to flow by way of the flapper door as described above.

The material used for the cast body portion must be easily drilled through using wellbore drill bits, and must provide enough strength to allow setting substantial force or weight down upon the casing shoe to work the casing past downhole obstructions without being damaged. The geometry of the cast body portion is created with a shape that allows it to contact downhole obstructions at an oblique angle. This may include geometries that are conical, hemispherical, wedge shaped, a swept arc or parabola, or some combination of the above. Typically a conical shape is used for larger casing diameters that cannot be rotated, and a circumferentially swept arc that forms a combination hemispherical/conical shape for smaller size casing that may be rotated when running into the hole. The body geometry may also contain flow passages or other axially spaced features to allow for fluid flow around the shoe body and to allow for scraping or moving cuttings from the low side of the wellbore into the annular flow path.

Testing has shown that multiple, circumferentially distributed high velocity jets create a zone of turbulent flow below the casing that is highly effective at transporting settled cuttings or caving-in out of the way of the casing, and helps distribute flow evenly around the bottom of the casing. This evenly distributed flow is helpful when circulating cement to ensure an even cement bond around the bottom of the casing.

High velocity flow through circumferentially distributed jets is effective at dissolving salt or tar though the use of appropriate solvents, such as water for salt and organic solvents such as toluene for tar. The high velocity jets work best with a flow velocity of 50 to 200 ft./sec, generating a total pressure drop of 150 to 500 psi. The larger centerline flow area should have a flow velocity of less than 50 ft./sec generating a pressure drop as low as possible, less than 20 psi, at normal flow or casing running rates.

In operation the casing shoe is threaded onto a section of casing, or a section of the casing shoe track such as a float collar. When running into the hole, the casing shoe allows displaced fluid to enter the casing. If a downhole obstruction is encountered, the casing is picked up off bottom, and the rig circulates fluid at a predetermined flow rate down the casing. This flow causes the flapper/check valve to close, which forces flow through the smaller flow area of the jetting nozzles, creating high energy, high velocity flow. One example might be running 7 inch casing in the Permian Basin in West Texas. Typical flow rates might be 150 gpm when running casing, with a maximum flow rate of 220 gpm. Therefore, a 7 inch embodiment would have 9×¼ inch diameter nozzles to generate high velocity flow and a pressure drop of approximately 250 psi at 150 gpm, and the flapper door shearing and opening at 200 gpm.

Figure 5:
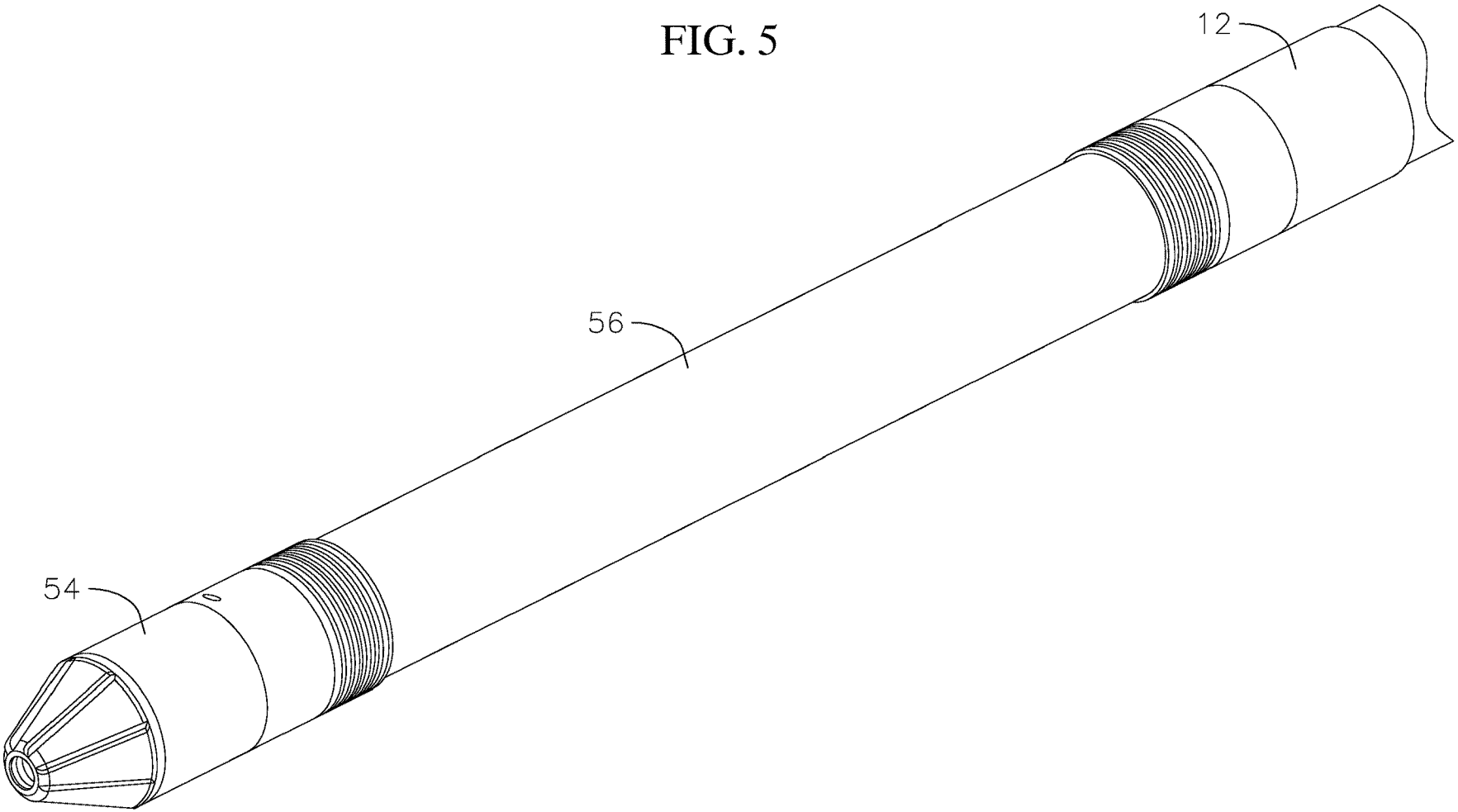
FIG. 5 is a perspective view of an alternative embodiment casing shoe of the present invention connected to a flexible casing guide.

As shown in FIG. 5, a casing shoe 54 can be used with a flexible casing guide 56. The casing shoe can be used to flush away cuttings and other material obstructions that are in front of the casing when there is not enough clearance to pass the casing, and the flexible casing guide can allow the casing to pass over ledges and other downhole obstructions more easily than stiff steel casing when there is enough clearance to allow the casing to pass. The flexible casing guide is described in detail in Applicant's U.S. Pat. No. 9,708,891, issued Jul. 18, 2017, and incorporated herein by reference.

The casing shoe can incorporate cutting elements 58 as shown in FIG. 1 embedded into the outside diameter of the shoe to enable reaming or broaching through obstructions within the wellbore. The casing shoe can then be used to flush away cuttings and other material obstructions that are scraped or cut loose from the wellbore, creating enough clearance to pass the casing. The cutting elements embodiment is described in detail in Applicant's U.S. Pat. No. 9,702,197, issued Jul. 11, 2017 and incorporated herein by reference.

Benefits of the casing shoe of the present invention include true high-velocity flow. Approximately two to ten times greater jetting velocity compared to other 'jetting' shoes. This enables jetting debris, cuttings, cave-in debris, tar, etc. out of the way, enabling a more efficient casing run. The fail-safe design enables the flapper door to shear at pre-determined pressure and flow rate to open a large flow area if nozzles become plugged, or if needed for cementing or pumping LCM. No metallic components within the body of the shoe means safe, fast, efficient drilling out of the shoe, The casing shoe is fully compatible with current auto-fill equipment, as fluid can enter the casing when running into the well with no significant restrictions due to the flapper design and large center opening area. The casing shoe is low cost to manufacture due to use of modern 3D printing and polyurethane/cement composite molding/casting methods, and use of polyurethane for the shoe body provides a strong, impact resistant, easily drilled material for the shoe structure, while the wear resistant properties of the material enable the high velocity nozzles to work effectively without eroding quickly.

Although the present invention has been described and illustrated with respect to various embodiments, the invention is not to be so limited since changes and modifications can be made therein which are intended to be covered by the claims as hereinafter stated.

What is claimed is:

1. A casing shoe comprising:

a cast composite body portion;

a cylindrical coupling portion having a threaded end for attachment to an end of a wellbore casing and a grooved end for attachment to one end of the body portion; and a one-way check valve assembly positioned in the body portion, the valve assembly and body portion having a centerline nozzle and a plurality of circumferentially spaced smaller diameter nozzles positioned around the centerline nozzle.

2. The shoe of claim 1 wherein the valve assembly includes a base, a flapper door positioned on the base and a seal positioned over the flapper door and hingedly connected to the base.

3. The shoe of claim 2 wherein the flapper door closes in a downhole direction and includes a series of tabs for engagement with the base, the tabs shear at a pre-determined differential pressure to open the centerline nozzle.

4. The shoe of claim 1 wherein the body portion has a conical shaped nose portion having an opening to the centerline nozzle.

5. The shoe of claim 1 wherein the body portion has a hemispherical shaped nose portion having an opening to the centerline nozzle.

6. The shoe of claim 1 wherein the body portion further includes ribs adjacent the check valve opposite the centerline nozzle.

7. The shoe of claim 2 wherein the flapper door includes a plurality of recesses to engage and lock the seal to the flapper door.

8. The shoe of claim 1 wherein the body portion has a plurality of cutting elements on an outer surface.

9. The shoe of claim 1 further comprising a flexible casing guide connected to the coupling portion opposite the body portion.

10. A casing shoe for attachment to casing comprising:

a body portion having a large area flow centerline nozzle and a plurality of smaller diameter high velocity flow nozzles circumferentially spaced around the centerline nozzle;

a one-way flapper valve positioned within the body portion adjacent the centerline nozzle which allows unobstructed flow into the casing through the centerline nozzle when in an open position and forces flow out of the smaller diameter high velocity flow nozzles while blocking the centerline nozzle in a closed position;

the flapper valve having means to convert the casing shoe to a large flow area out of the casing shoe; and a coupling for attaching the body portion to the casing.

11. The shoe of claim 10 wherein the flapper valve includes a base, a flapper door positioned on the base and a seal positioned over the flapper door.

12. The shoe of claim 11 wherein the flapper valve further includes a hinge for connection at least one of the flapper door or seal to the base.

13. The shoe of claim 11 wherein the means to convert the casing shoe to a large flow out area is a series of tabs positioned around a perimeter of the flapper door which engage recesses in a base, the tabs being configured to shear at a pre-determined pressure differential between an inside and an outside of the casing shoe to open the centerline nozzle.

14. The shoe of claim 10 wherein the body portion has a conical shaped nose portion having an opening to the centerline nozzle.

15. The shoe of claim 10 wherein the body portion has a hemispherical shaped nose portion having an opening to the centerline nozzle.

16. The shoe of claim 10 wherein the body portion further includes at least one rib adjacent the flapper valve opposite the centerline nozzle.

17. The shoe of claim 11 wherein the flapper door includes a plurality of recesses to engage and lock the seal to the flapper door.

18. The shoe of claim 10 wherein the body portion has a plurality of cutting elements on an outer surface.

19. The shoe of claim 10 further comprising a flexible casing guide connected to the coupling portion opposite the body portion.

* * * * *